United States Patent [19]

Marshall

[11] 4,317,423

[45] Mar. 2, 1982

[54] ANCHOR

[76] Inventor: Don J. Marshall, Box 157, 1087 Rodgers Rd., Churchton, Md. 20733

[21] Appl. No.: 189,322

[22] Filed: Sep. 22, 1980

Related U.S. Application Data

[63] Continuation of Ser. No. 963,040, Nov. 22, 1978, abandoned.

[51] Int. Cl.[3] ..... B63B 21/44

[52] U.S. Cl. ..... 114/297; 114/299; 114/303

[58] Field of Search ..... 114/304, 308, 309, 310, 114/297, 298, 299, 303

[56] References Cited

U.S. PATENT DOCUMENTS

| | | | |
|---|---|---|---|
| 503,694 | 8/1893 | Byrne | 114/310 |
| 2,679,226 | 5/1954 | Thayer | 114/297 |
| 3,774,569 | 11/1973 | Linnenbank | 114/309 |
| 4,154,187 | 5/1979 | Taylor et al. | 114/304 |

*Primary Examiner*—Sherman D. Basinger
*Attorney, Agent, or Firm*—William J. Dick

[57] ABSTRACT

A boat or ship anchor having a crown portion with a spaced apart pair of flukes projecting forwardly therefrom in the same plane, and a pair of tail plates extending rearwardly therefrom, the tail plates being splayed to present a large frontal area. Intermediate the flukes and extending through the crown is an aperture. A shank element, adapted for attachment to the anchor line at its forward end, extends through the aperture and is dimensioned for sliding relation in the aperture intermediate the flukes. A projection in the form of a minor fluke on the tail end of the shank element limits the sliding motion of the shank through the aperture in a first direction while permitting limited rotational or angular movement thereof relative to the flukes and crown at least in a plane perpendicular to the plane of the flukes. In operation, with tension on the anchor line or chain, the minor fluke holds the shank to the crown, while the flukes and the tail plates combine their functions to provide increased holding powder without overly deep penetration of the bottom. When it is desired to release the anchor from the bottom, the anchor line tension being reversed, the shank element slides through the aperture, the minor fluke impinging upon or into the bottom acting as a fulcrum about which the shank rotates, the shank acting as a lever to pull the flukes from the bottom along the same line of action as they entered. In the event of accidental release of the anchor, the action is as described above, the flukes then flipping or rotating about the shank element and burying themselves into the bottom on the opposite side in the direction of tension of the anchor chain connected to the shank element.

10 Claims, 12 Drawing Figures

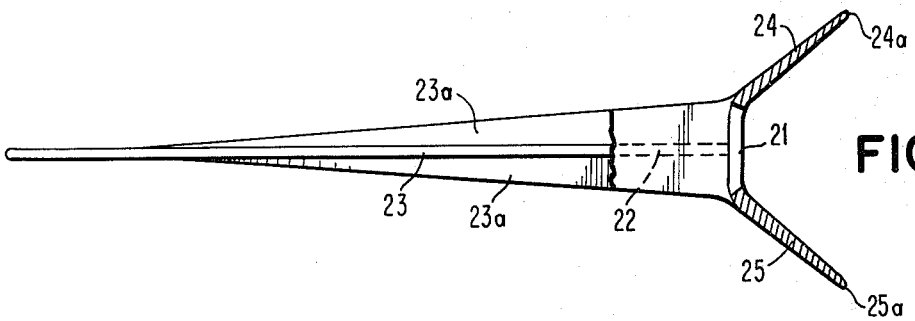
FIG. 5
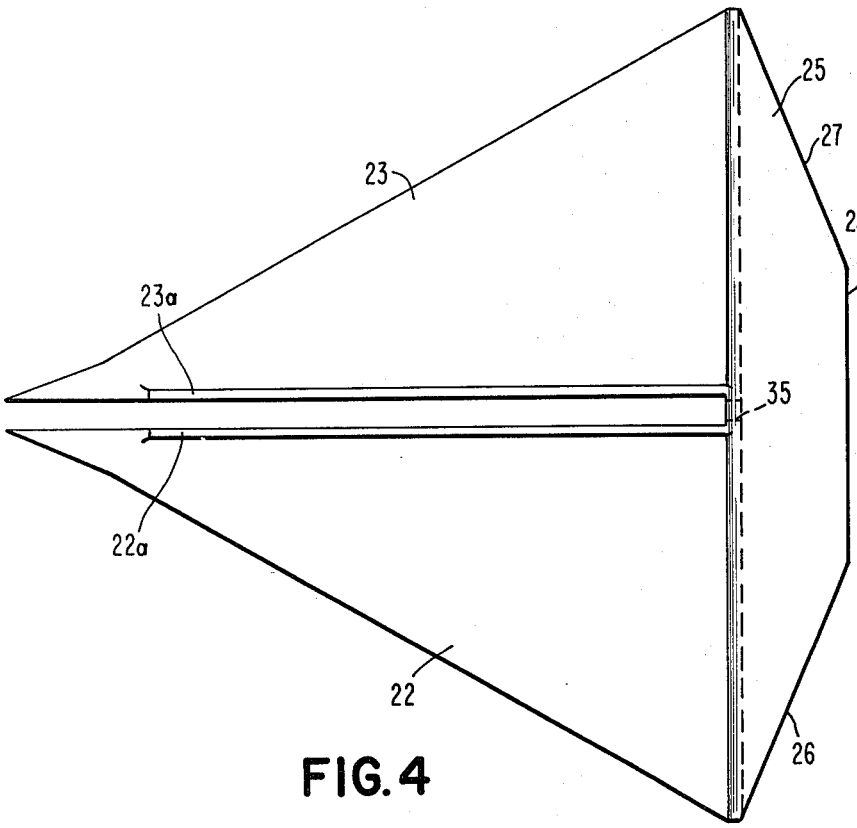
FIG. 4
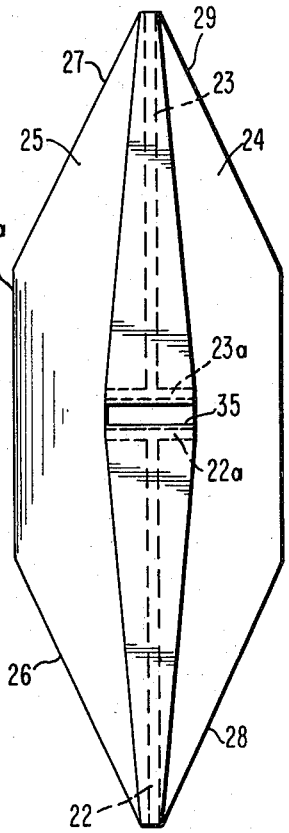
FIG. 6
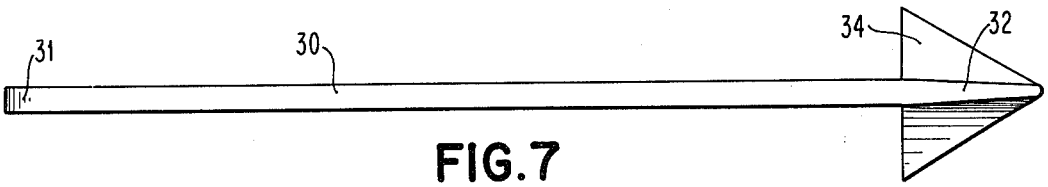
FIG. 7
FIG. 8
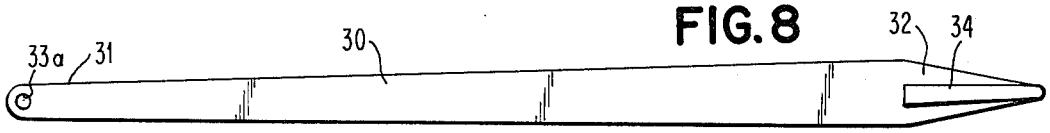

ANCHOR

This is a continuation, of application Ser. No. 963,040 filed Nov. 22, 1978, now abandoned.

TECHNICAL FIELD OF THE INVENTION

The present invention relates to boat or ship anchors, and more specifically relates to an improved "mud-hook" or "spade fluke" type anchor which will reset itself in the event it is accidentally loosened by a change of wind or tide direction but moreover is easily released from the bottom when desired by the boatsman.

Background Art

From the viewpoint of overall safety at sea, there is perhaps no single item of ships hardware more important than its anchor. The ability to hold position in face of strong currents and winds, whether to prevent its "grounding" or shipwreck, or simply to hold place in a crowded anchorage, is of paramount importance to the ship and the lives of her crew.

Over the past thousands of years, many anchor designs have appeared, each representing the best thinking of seamen and naval architects of the time, each more or less well suited to the needs of the craft in use, and each of the successive designs planned to meet changing needs of each step in modernization of seafaring craft.

The earliest of these still in use is the Kedge, used mainly on rocky bottoms. This anchor is heavy, cumbersome, and almost useless in soft mud or sand. A later development is the "Navy" anchor, having a massive crown section and twin forward facing semi-spade flukes. A "compromise" design, its holding power on all bottoms depends on its massive weight, necessitating mechanized gear for handling and stowage.

In the more modern era, designers have constantly striven for increased holding power with decreased weight, lending to such designs as Wilcox Critenden, Laughlin CQR Plow, Northill, Danforth, and Benson.

The Danforth was the first commercially developed full-spade anchor, and offered previously unheard-of holding power in sand, mud, and clay. Such an anchor 10 is schematically shown in FIG. 1A deeply imbedded in a mud or sand-clay bottom 12. As shown, a shank 13 of the anchor is pivotally mounted to a crown portion 14 and an anchor line or chain 16 is attached to the opposite end of the shank as by a ring 15, the withdrawal line tension creating a couple about the shank pivot point resulting in a rotative force rather than the necessary rearward force. Unfortunately, coupled with its great holding power is a propensity for the anchor 10 to bury itself to extreme depths, making its release from certain types of bottom difficult-to-impossible, as the normal reversal of line tension in the inhaul attempt, such as shown in FIG. 1A, creates a need for a rotative action of the flukes, this resisted by the shear stresses associated with a mud-clay bottom, and by a vacuum beneath the lower surfaces of its flukes.

An attempt to effect easier release is found in the Benson anchor and its imitators. In this design, such as shown in FIG. 1B, a skeleton shank **13*a* and sliding ring 15*a* are utilized, so that inhaul tension forces are transferred to the aft or crown portion 14*a* allowing the flukes 11*a* to be withdrawn essentially on plane with the entry angle of the flukes. This design has a serious shortcoming however, in that once the anchor is released from the bottom, such as shown in FIG. 1B, the continued inhaul of the anchor chain 16*a* or drift force tends to drag the anchor backward, incapable, except by chance reversal of the flukes, of resetting itself. In the instance of accidentical release via reversed tide or winds, the anchor may drag for dangerous distances, there being only a chance collision with a bottom protuberance to effect the necessary reversal of the flukes 11*a*, as the ring 15*a* is resting at the aft root of the shank 13*a***, and all tension forces tend to hold it in that position.

For a more complete description of the art of anchoring, its problems and difficulties, and the advantages and disadvantages of the many prior art anchors reference may be had to Popular Mechanics "Do It Yourself" Encyclopedia, Copyright 1968, The Hearst Corporation, pages 84–88, or to any of the annual issues of the widely respected and most authorative "Piloting, Seamanship, and Small Boat Handling", Charles F. Chapman, published by Motor Boating. The latter publication is used almost exclusively as a textbook in Coast Guard and Power Squadron training courses, and carries an excellent discussion of the correct methods of anchor handling, the preventative measures and gear for attachment to and use with prior art anchors in order to avoid the dangers of free drift in cases of loss of anchor holding power because the changing tide currents and winds, along with methods of attempting the recovery of anchors which are deeply imbedded, including "trip lines", "snap rings" and the like.

In view of the above, it is an object of the present invention to provide an anchor with increased holding power without the necessity of deep imbedment to achieve that effect.

Another object of the present invention is to provide an anchor which may be released from the bottom when desired with a minimum of effort.

Still another object of the present invention is to provide an anchor having means for a guided and controlled re-setting capability in the event of accidental release.

Other objects and a more complete understanding of the invention may be had by reference to the following specifications and claims taken in conjunction with the accompanying drawings in which:

DESCRIPTION OF THE DRAWINGS

FIG. 4 is an enlarged view in plan of a portion of the anchor illustrated in FIG. 3;

FIG. 5 is a side elevational view of that portion of the anchor illustrated in FIG. 4;

FIG. 6 is a bottom view of the portion of the anchor illustrated in FIGS. 4 and 5;

FIG. 7 is a view in plan of the shank portion of the anchor of the present invention; and FIG. 8 is side elevational view of the shank illustrated in FIG. 7.

Figure 1A:
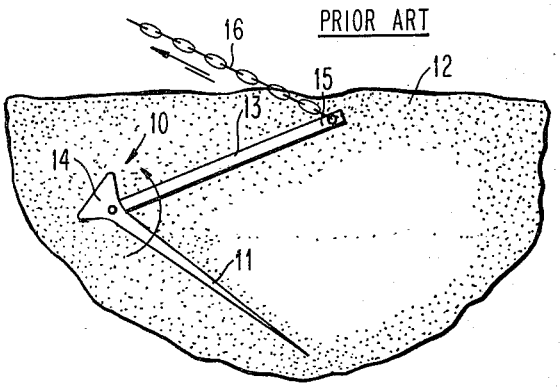
FIGS. 1A and 1B illustrate two different prior art anchors discussed above, FIG. 1A showing the problem in freeing a prior art anchor when desired from the bottom by illustrating the need for fluke rotation due to shank angle, FIG. 1B showing the lack of any positive fluke reversing device.
Figure 1B:
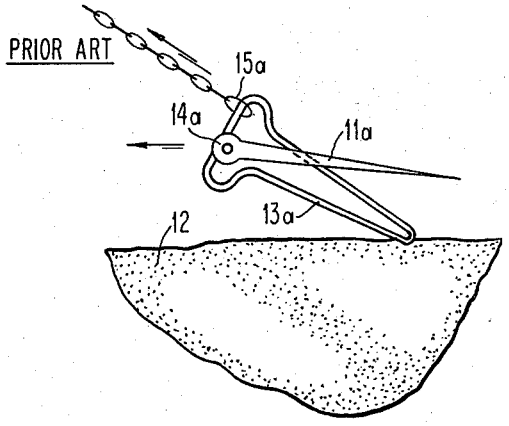

In accordance with the invention, and referring first to FIGS. 3–8, an improved anchor 20 is provided which will develop the holding power equal to any of the prior art anchors heretofore described, but which may easily released from the bottom, and if dislodged accidentally by winds or tides will quickly reset itself. As shown, the anchor 20 includes a crown portion 21 having a pair of laterally spaced apart flukes 22 and 23 respectively projecting from the crown, the flukes lying in the same plane. Each of the flukes 22 and 23 includes an upstanding reinforcing web or flange 22*a*, 23*a* respectively which face each other and are substantially perpendicular to the plane of the flukes. The flukes are generally triangular in plan with a narrow pointed bill or tip portions 22*b* and 23*b* respectively. Projecting from the crown 21 in the opposite direction from the flukes 22 and 23 are tail plates 24 and 25 which are splayed outwardly from the plane of the major flukes 22 and 23 (see FIG. 5). The tail plates 24 and 25 have a heel portion 24*a*, 25*a*, and in the present instance are tapered inwardly in plan (FIG. 4) as at 26, 27, 28, 29 so as to merge into the crown portion 21 of the anchor 20.

In order to connect the flukes to an anchor chain or cable or line to the anchor, and in accordance with the invention, a shank element 30 is mounted with respect to the flukes for both sliding and rotational movement. The shank 30 has a head end 31 and a tail or crown end 32, the head end being adapted to receive a ring or the like 33 or be directly connected as through an aperture 33*a* (see FIG. 8) to a line, cable or chain. The tail end or crown end 32 includes laterally entending projections, in the illustrated instance a minor spade-like fluke shaped tip 34, the purpose of which will become more clear hereinafter. Referring once again to FIGS. 3–6, the crown 21 includes an aperture 35 (in the present instance rectangular) therein intermediate the flukes 22 and 23, the shank 30 being dimensioned in relation to the aperture 35 to permit the shank to pass through the aperture intermediate the webs 22*a* and 23*a* of the flukes 22 and 23 and to coact with the aperture 35 in sliding relation with respect thereto. The projection or fluke 34 is dimensioned so as to limit the sliding motion of the shank portion through the aperture by abuting the projection 34 against the underside of the crown 21. However, the aperture is dimensioned in conjunction with the shank 30 to permit limited rotational or pivotal movement, that is into and out of plane of the flukes 22 and 23 about the crown 21 and intermediate the flukes 22 and 23 and to inhibit rotation of the shank about its own axis.

In operation, and referring to FIGS. 2A–2D, assume that the anchor 20 is in position, with the flukes 22 and 23 buried in a muddy or clay like bottom with an anchor chain or cable 40 connected to the ring 33 associated with the shank 30. It should be noted that the greatly increased frontal area (see FIG. 6) of the tail plates 24 and 25 inhibits overly deep penetration of the bottom, while the normal drag resistance of the flukes 22 and 23, plus the resistance force developed by the bottom against the forward face of the tail plates 24 and 25 combine to create a very considerable vector force as holding power. In very soft mud or the lightest of sand bottoms, some anchor "bury" will be effected, but even in this type bottom, no great difficulty of release is found. In this connection, the frontal area of the tail plates should be large, in the preferred instance equal to at least one half, ($\frac{1}{2}$), the area of the flukes. As is conventional, with tension on the cable in the direction of the arrow 41 illustrated in FIG. 2A, the flukes and shank will assume the position illustrated in the drawing.

Figure 2A:
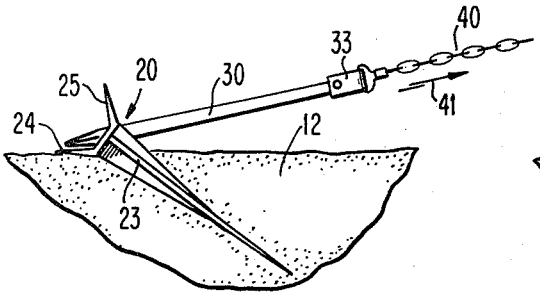
FIGS. 2A–2D is a motion study of an anchor constructed in accordance with the present invention and its operation for removal thereof from a bottom for either resetting or for raising the anchor.
Figure 2B:
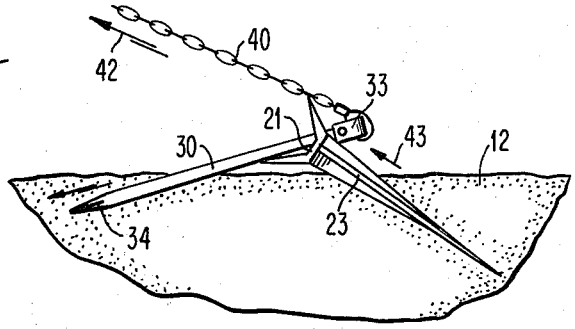

Assume that it is desired to raise anchor, and as is conventional, the cable, line, or chain 40 direction of pull will be shifted to the opposite direction such as shown by the arrow 42 in FIG. 2B by backing down the hull. Because of the sliding relation of the shank 30 with respect to the crown 21 of the anchor 20 the shank will move rearwardly through the aperture and due to the minor fluke 34 on the tip of the shank will start to dig into the bottom 12. Continued pulling on the cable 40 will cause the shank 30 to act as a lever against the crown 21 and instead of attempting to rotate the flukes to pull the flukes free will attempt to pull the flukes straight out (parallel to their angle of bottom penetration) as indicated by the directional arrow 43 illustrated in FIG. 2B. Once the flukes 22 and 23 are free the tail plates, in the present instance plate 24 will act as a pivot for the flukes 22 and 23 and the flukes will rotate about the shank. As in conventional anchoring, the moment of release is clearly signalled by a sudden decrease of line tension, the craft now "runs up" on its anchor point, and the anchor is retrieved by a more or less vertical inhaul, preventing resetting.

Figure 2C:
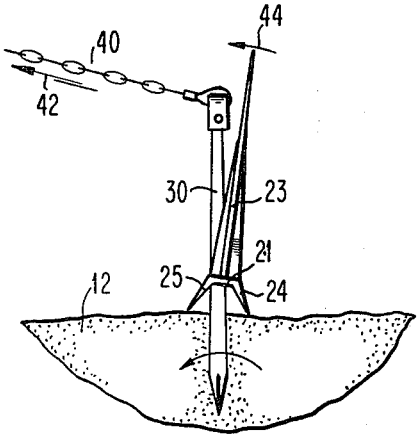
Figure 2D:
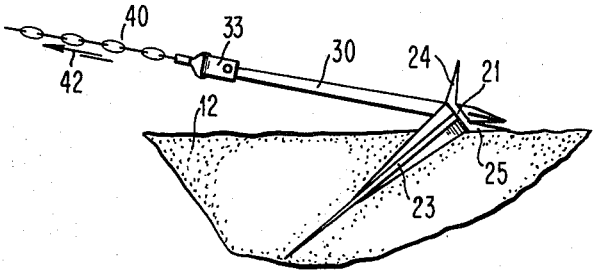
Figure 3:
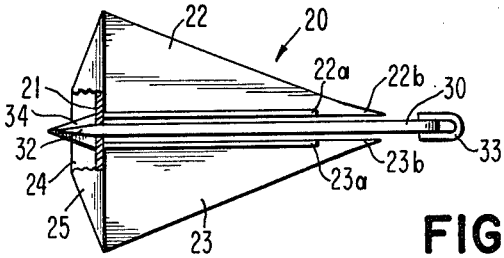
FIG. 3 is a plan view of an anchor constructed in accordance with the present invention and illustrated in action in FIGS. 2A–2D.

Alternately, if the action that occurred in FIGS. 2B and 2C was inadvertant, that is if the action occurred because of the boat turning on anchor due to wind or tide conditions, and the flukes are released by the action illustrated in FIG. 2B, continued pulling on the cable, line or anchor 40 in the direction of the arrow 42 will cause the flukes 22 and 23 to flop over virtually in place to the opposite side and once again dig into the bottom 12 in the direction of drift so as to restrict the sliding motion of the anchor along the bottom. The arresting action of anchor drag is at first due to the minor fluke 34 entering the bottom and acting as a fulcrum with the shank acting as a lever, and then the flukes 22 and 23 digging into the bottom.

Thus the anchor of the present invention may be easily removed or released from the bottom, and, even in the event of unattended boats, or ships if inadvertently dislodged, will reset itself.

Although the invention has been described with a certain degree of particularity, it is understood that the present disclosure has been made only by way of example and that numerous changes in the details of construction and the combination and arrangement of parts may be made without departing from the spirit and scope of the invention as hereinafter claimed:

What is claimed is:

1. An anchor for holding in a bottom underlying a body of water, said anchor comprising in combination; a crown portion having a spaced apart pair of flukes projecting therefrom; means defining an aperture in said crown intermediate said flukes, a shank element extending through said aperture and dimensioned for sliding movement in said aperture and intermediate said flukes; means on said shank element for attaching an anchor line thereto, a sharp pointed, spade-like minor fluke projection on one end of said shank element to limit the sliding motion of said shank portion through said aperture in a first direction, said aperture and shank dimensioned to allow rotational movement of the shank relative to the plane of said flukes and crown whereby upon reversal of the direction of pull on said shank by said anchor line, rotation of said shank element occurs, said shank element slides rearwardly through said aperture and said sharp pointed, spade-like minor fluke projection digs into the bottom underlying said body of water and acts as a fulcrum for said shank element for fluke release from said bottom.

2. An anchor in accordance with claim 1 wherein said flukes lie in the same plane and a pair of tail plates spaced apart project from said crown portion in a direction opposite from said flukes.

3. An anchor in accordance with claim 2 wherein said tail plates are splayed outwardly from the plane of said flukes.

4. An anchor in accordance with claim 3 wherein said tail plates include a heel portion, and are tapered inwardly in plan so as to merge into said crown portion.

5. An anchor in accordance with claim 4 wherein said flukes are substantially triangular in plan.

6. An anchor in accordance with claim 5 including upstanding flanges on said flukes on opposite sides of said aperture.

7. An anchor, comprising in combination: a crown portion having a pair of splayed apart tail plates projecting substantially rearward and extending the full width of said crown portion; a pair of spaced-apart flukes projecting forward of said crown; means defining an aperture in said crown intermediate said flukes; a shank element mounted through said aperture and intermediate said flukes for sliding movement and angular displacement above and below the plane of said flukes, said shank and aperture dimensioned to limit said angular displacement and to inhibit rotation of said shank about its own axis; said shank having a sharp pointed, spade-like minor fluke located at the aft extremity of said shank and including means for attachment to an anchor line at the forward extremity of said shank; said sharp pointed, spade-like minor fluke dimensioned to arrest sliding motion of said shank in one direction and to arrest anchor drag in the opposite direction by digging into the bottom underlying a body of water.

8. An anchor in accordance with claim 7 wherein said flukes lie in the same lateral plane.

9. An anchor in accordance with claim 8 in which the said tail plates are respectively angularly displaced out of the plane of said flukes.

10. An anchor in accordance with claim 9 in which said tail plates present a frontal area equal to at least one half of the area of said flukes.

* * * * *